US006025676A

United States Patent [19]

Ohama et al.

[11] Patent Number: 6,025,676

[45] Date of Patent: Feb. 15, 2000

[54] CATHODE RAY TUBE HAVING IMPROVED CURVATURE CHARACTERISTICS AND METHOD OF FABRICATION THEREOF

[75] Inventors: Shinji Ohama, Hyogo-ken; Norio Shimizu; Shinichiro Nakagawa, both of Fukaya; Masatsugu Inoue, Kumagaya; Kumio Fukuda, Fukaya, all of Japan

[73] Assignee: Kabushiki Kaisha Toshiba, Kawasaki, Japan

[21] Appl. No.: 08/952,080

[22] PCT Filed: Mar. 3, 1997

[86] PCT No.: PCT/JP97/00630

§ 371 Date: Nov. 4, 1997

§ 102(e) Date: Nov. 4, 1997

[87] PCT Pub. No.: WO97/33298

PCT Pub. Date: Sep. 12, 1997

[30] Foreign Application Priority Data

| | | | |
|---|---|---|---|
| Mar. 6, 1996 | [JP] | Japan | 8-049029 |
| Mar. 6, 1996 | [JP] | Japan | 8-049030 |
| Jan. 13, 1997 | [JP] | Japan | 9-003632 |

[51] Int. Cl.[7] ..... H01J 29/86

[52] U.S. Cl. ..... 313/477 R; 313/402; 313/408

[58] Field of Search ..... 313/477 R, 402, 313/807, 408; 445/37

[56] References Cited

U.S. PATENT DOCUMENTS

| | | | |
|---|---|---|---|
| 2,728,012 | 12/1955 | Swedlund . | |
| 4,136,300 | 1/1979 | Morrell | 313/403 |
| 4,162,421 | 7/1979 | Morrell | 313/402 |
| 4,286,189 | 8/1981 | Koizumi et al. | 313/402 |
| 4,537,321 | 8/1985 | Tokita | 313/477 R |
| 4,537,322 | 8/1985 | Okada et al. | 313/477 R |
| 4,746,315 | 5/1988 | Sumiyoshi | 445/37 |
| 4,985,658 | 1/1991 | Canevazzi | 313/477 R |
| 5,107,999 | 4/1992 | Canevazzi | 313/477 R |
| 5,155,410 | 10/1992 | Wakasono et al. | 313/477 R |
| 5,216,321 | 6/1993 | Kawamura et al. | 313/479 |

FOREIGN PATENT DOCUMENTS

| | | |
|---|---|---|
| 39-020726 | 7/1964 | Japan . |
| 52-058357 | 5/1977 | Japan . |
| 62-002434 | 1/1987 | Japan . |
| 63-232247 | 9/1988 | Japan . |
| 63-017360 | 1/1989 | Japan . |
| 2-148544 | 6/1990 | Japan . |
| 4-003619 | 1/1992 | Japan . |
| 4-014735 | 1/1992 | Japan . |
| 4-229534 | 8/1992 | Japan . |
| 5-006787 | 1/1993 | Japan . |

*Primary Examiner*—Vip Patel
*Assistant Examiner*—Matthew J Gerike
*Attorney, Agent, or Firm*—Pillsbury Madison & Sutro LLP

[57] ABSTRACT

A face panel (12) constituting a part of a vacuum envelope (20) has a substantially rectangular effective area (10), the inner surface of which is formed with a phosphor screen (14). The effective area has a long axis (X) extending in the horizontal direction and a short axis (Y) extending in the vertical direction. The outer surface of the effective area is cylindrically curved with an infinitely large radius of curvature along the long axis and a predetermined radius of curvature along the short axis. The vacuum envelope has arranged therein a shadow mask (15) in opposed relation to the phosphor screen. A mask body of the shadow mask has a substantially rectangular effective surface cylindrically curved with an infinitely large radius of curvature along the long axis and a predetermined radius of curvature along the short axis thereof. In manufacturing the shadow mask, a flat mask is subjected to a plastic deformation into a cylindrical shape curved along the short axis and then subjected to an elastic deformation in such a manner that the radius of curvature thereof is larger than at the time of plastic deformation. The mask body thus formed by elastic deformation is fixed to a rectangular frame.

29 Claims, 8 Drawing Sheets

CATHODE RAY TUBE HAVING IMPROVED CURVATURE CHARACTERISTICS AND METHOD OF FABRICATION THEREOF

BACKGROUND OF THE INVENTION

1. Field of the Invention

The present invention relates to a cathode ray tube having a substantially flat face panel and a method of manufacturing the same.

2. Description of the Related Art

Generally, a color cathode ray tube is provided with a vacuum envelope having a glass face panel and a glass funnel. A phosphor screen having three-color phosphor layers is formed on the inner surface of the effective area of the face panel, and an electron gun is arranged in the neck of the funnel. Three electron beams emitted from the electron gun are deflected by the magnetic field generated by a deflector mounted on the outside of the funnel, and scan horizontally and vertically on the phosphor screen through a shadow mask, thereby displaying a color image.

The face panel of a color cathode ray tube having this configuration generally includes a substantially rectangular effective area and a side wall erected along the peripheral portion of the effective area. The face panel is formed with inner and outer surfaces curved so differently that the central portion of the effective area is thinner than the peripheral portion thereof in order to secure a sufficient strength to resist the atmospheric load applied to the vacuum envelope.

Generally, the outer surface of the effective area is formed with such a curvature that the height with respect to the sealed surface between the face panel and the funnel is greatest at the central portion of the effective area and lower toward the peripheral portion. Specifically known face panels include the one with the outer surface of the effective area having a spherical curvature, the one having a cylindrical outer surface with a substantially infinitely large radius of curvature along the vertical axis and a curvature along the horizontal long axis, and the one having a curved outer surface expressed by a high-order polynomial.

With respect to the shape of the outer surface of the effective area of the face panel, the recent trend is toward the flattening in order to improve the visibility. Depending on the curved geometry of the outer surface of the effective area of the face panel, a generally known method of indicating the flatness of the effective area includes the index R. The index R is given as the ratio of the average radius of curvature of the corners determined by the difference (the fall of the corners) between the height of the central portion of the face panel and the height of the corners of the face panel to the diagonal length of the effective area multiplied by a factor of 1.7. In the case where the flatness expressed by this index R remains the same, the fall at the corners is the same for any shape of the curved outer surface of the effective area, and though somewhat depending on the geometry of the curved surface, the feeling of flatness of the effective area of the face panel is substantially equal.

With the increase of the flatness of the face panel, however, the atmospheric strength of the glass vacuum envelope decreases. The flatness of the outer surface of the effective area, therefore, is at most about 2.0R even for a large cathode ray tube.

On the other hand, various shapes are available for the inner surface of the effective area of the face panel. The inner surface of the effective area, however, is often formed in the same type of curvature as the outer surface of the effective area so that the effective area is thinnest at the central portion thereof and thicker toward the peripheral area in order to maintain the atmospheric strength required of the glass vacuum envelope.

In recent years, the atmospheric strength of the glass vacuum envelope has improved due to an improved design accuracy of the face panel and an improved performance of the reinforcing band to such an extent that a predetermined strength is secured even with a flattened face panel. In the case where the inner and outer surfaces of the face panel are configured of the same type of curvature as described above, however, a still higher strength of the vacuum envelope against the atmospheric pressure is required if the effective area of the face panel is to be flattened more. This in turn requires reinforcing by increasing the glass thickness greatly or attaching a reinforcing film on the outer surface of the effective area of the face panel at the sacrifice of a remarkably higher cost.

On the other hand, there exists a cathode ray tube comprising a face panel having a substantially flat outer surface of the effective area. In this cathode ray tube, however, the inner surface of the face panel is formed by a combination of curved surfaces like the well-known face panel. For this reason, the vacuum envelope is reinforced by thickening the effective area of the panel or attaching a reinforcing film on the outer surface of the effective area of the face panel in order to secure the atmospheric strength of the vacuum envelope. This leads to a considerably higher cost as in the above-mentioned case.

With the color cathode ray tube, the shadow mask is configured of a substantially rectangular flat mask body about 0.1 to 0.3 mm thick and a substantially rectangular frame fixed on the peripheral portion of the mask body. The effective surface of the mask body is opposite to the phosphor screen and the effective surface is formed with a number of apertures allowing the electron beams to pass therethrough.

Generally, the effective surface of the mask body is shaped in conformance with the inner surface of the effective area of the face panel and has at least a curved central portion protruding toward the phosphor screen. The shape of the curved surface conventionally used includes a cylindrically curved surface having a predetermined curvature along the horizontal axis and a substantially infinitely large radius of curvature along the vertical axis or a curved surface expressed by a high-order polynomial.

Regardless of the shape of the curved surface of the shadow mask, the electron beam apertures of the shadow mask and the phosphor layer are required to be in specified relative positions in order to assure the accurate landing of the electron beams on the phosphor layers. The same relative positions are always required to be maintained through the whole operation of the cathode ray tube. In other words, the distance between the shadow mask and the phosphor screen must always be within a predetermined tolerance.

The amount of the electron beams that reaches the phosphor screen through the electron beam apertures of the shadow mask, however, is not more than one third of all the electron beams emitted from the electron gun, and the remaining electron beams bombard the shadow mask. The electron beams that have thus bombarded the shadow mask are converted into thermal energy to heat and expand the shadow mask.

The thermal expansion of the shadow mask increases the displacement of the beam landing and the deterioration of the color purity. The magnitude of the mislanding caused by the thermal expansion of the shadow mask is greatly varied with the image pattern displayed and the time during which an image pattern is sustained. Especially in the case where a locally high-luminance image pattern is displayed, the local doming of the shadow mask occurs so that the mislanding of the electron beam is caused within a short time resulting in a great displacement of the electron beam. The mislanding is most conspicuous in the case where the doming of the shadow mask occurs at a portion located toward the center from the horizontal end of the effective surface of the shadow mask by about one third of the horizontal length.

The two methods of forming the curved surface of the shadow mask include using the press work and (2) applying a tension. In the method using the press work, a planar mask plate (flat mask) made of a thin metal with a number of electron beam passage apertures is subjected to plastic deformation in the press. This method is used mainly for forming a spherical surface or a curved surface expressed by a high-order polynomial, as described above.

The second method of forming the curved surface of the shadow mask under tension is used for producing a cylindrical surface with a predetermined radius of curvature along the horizontal axis and a substantially infinitely large radius of curvature along the vertical axis. In this method, a planar plate of a thin metal with a number of electron beam passage apertures is arranged along the frame. The frame has a mask-mounting surface curved along the horizontal axis with a substantially infinitely large radius of curvature along the vertical axis. This mask plate is fixed to the frame under a tension applied along the vertical axis of the mask plate.

As described above, the curved surface of the shadow mask has been flattened and has an increasingly larger radius of curvature with the flattening of the face panel. With the increase in the curvature of the shadow mask, the strength of holding the curved surface of the shadow mask is reduced. As a result, the effective surface of the shadow mask is easily deformed under a shock or other external forces applied to the color cathode ray tube. Also, in the case where the color cathode ray tube is exposed to a vibration, the shadow mask is liable to develop a resonance (howling). In either case, the color purity of the displayed image is deteriorated.

The strength of holding the curvature of the flattened shadow mask can be improved by increasing the thickness of the shadow mask. An increased thickness of the shadow mask, however, makes it difficult to form the electron beam passage apertures by photoetching and difficult to obtain beam passage apertures with desired shape and size. Further, the cost of the material of the shadow mask increases.

As a measure for improving the curved surface-holding strength, a method is conceivable in which the shadow mask is mounted under a tension applied along the direction of the vertical axis having an infinitely large radius of curvature. In this case, however, the requirement of applying a very large tensile force to the shadow mask necessitates a very high strength of holding the shadow mask. As a result, the production cost of the color cathode ray tube increases. At the same time, the increased frame weight greatly increases the whole weight of the cathode ray tube.

SUMMARY OF THE INVENTION

The present invention is designed in consideration of the above circumstances, and its objective is to provide a cathode ray tube and a method of manufacturing the same in which the flatness of the effective area of the face panel and the visibility can be easily improved without increasing the production cost substantially.

In order to achieve this objective, according to one aspect of the present invention, a cathode ray tube comprises a vacuum envelope having a face panel with a substantially rectangular effective area and a funnel; a phosphor screen formed on an inner surface of the face panel; and an electron gun arranged in a neck of the funnel for emitting electron beams toward the phosphor screen. The effective area of the face panel has a long axis extending in the horizontal direction and a short axis extending in the vertical direction. The outer surface of the effective area is formed in a cylindrically curved shape having a substantially infinitely large radius of curvature along the long axis and a fixed radius of curvature along the short axis over the entire outer surface.

In this aspect of the invention, the outer surface of the effective area has a radius of curvature along the short axis expressed by a high-order polynomial.

Also, the ratio of the size along the long axis to the size along the short axis of the effective area is set to 16:9.

According to another aspect of the present invention, a cathode ray tube comprises a vacuum envelope having a face panel with a substantially rectangular effective area and a funnel; a phosphor screen formed on an inner surface of the face panel; and an electron gun arranged in a neck of the funnel for emitting electron beams toward the phosphor screen. The effective area of the face panel has a long axis extending in the horizontal direction and a short axis extending in the vertical direction. The outer surface of the effective area is formed in the shape of a curved surface having a substantially infinitely large radius of curvature along the long axis and a radius of curvature along the short axis which is different between the portion on the short axis and a portion near the short side of the effective area.

The cathode ray tube having the above-mentioned configuration, can improve the strength of the vacuum envelope over the conventional cathode ray tube by taking advantage of the difference between the lateral and longitudinal sizes of the face panel even in the case where the panel has substantially the same flatness as conventional cathode ray tubes. Further, if the strength is the same as the conventional cathode ray tube, it is possible to provide a cathode ray tube improved in the flatness of the face panel.

According to another aspect of the invention, a cathode ray tube comprises a vacuum envelope having a face panel with a substantially rectangular effective area and a funnel; a phosphor screen formed on an inner surface of the face panel; and an electron gun arranged in a neck of the funnel for emitting electron beams toward the phosphor screen. The effective area of the face panel has a long axis extending in the horizontal direction and a short axis extending in the vertical direction. The outer surface of the effective area is formed substantially flat, and the inner surface of the effective area has a cylindrically curved shape with a substantially infinitely large radius of curvature along the long axis and a fixed radius of curvature along the short axis over the whole inner surface.

The ratio between the sizes along the long axis and the short axis of the effective area is set to 16:9.

In the cathode ray tube according to this aspect of the invention, the effective area of the face panel has a long axis extending in the horizontal direction and a short axis extending along the vertical direction, and the outer surface of the effective area is curved with a substantially infinitely large radius of curvature along the long axis and a predetermined radius of curvature along the short axis.

The inner surface of the effective area is cylindrically curved and has a substantially infinitely large radius of curvature along the long axis and a predetermined radius of curvature along the short axis over the whole inner surface.

With a cathode ray tube having this configuration, the flatness of the outer surface of the effective area of the face panel can be improved to configure a color cathode ray tube with a superior visibility without reinforcing the face panel considerably.

According to still another aspect of the invention, a cathode ray tube comprises a vacuum envelope having a face panel with a substantially rectangular effective area and a funnel; a phosphor screen formed on an inner surface of the face panel; a shadow mask arranged in the vacuum envelope to oppose the phosphor screen and include a mask body having a substantially rectangular effective surface opposite to the phosphor screen and a number of electron beams passage apertures formed in the effective surface, and a substantially rectangular frame supporting the peripheral edge of the mask body; and an electron gun arranged in a neck of the funnel for emitting electron beams toward the phosphor screen.

The effective surface of the mask body has a long axis extending in the horizontal direction and a short axis extending in the vertical direction. The mask body is formed in the shape of a cylindrically curved surface having a substantially infinitely large radius of curvature along the long axis and a substantially fixed radius of curvature along the short axis over the whole effective area.

Also, with a cathode ray tube according to another aspect of the invention, the effective surface of the mask body has a long axis extending along the horizontal direction and a short axis extending along the vertical direction. The effective surface of the mask body is formed in a curved surface with a radius of curvature along the long axis is substantially infinitely large and a radius of curvature along the short axis expressed by a high-order polynomial.

With the cathode ray tube having the above-mentioned configuration, the effective surface of the mask body is formed as a curved surface having a substantially infinitely large radius of curvature along the long axis and a fixed radius of curvature along the short axis or as a curve surface expressed by a high-order polynomial. The strength of holding the curved surface of the shadow mask is thereby considerably improved. Also, the flatness is improved and the face panel can be readily flattened while holding a curved surface-holding strength of the shadow mask equivalent to the conventional shadow mask. Further, the thickness of the shadow mask can be reduced for the same flatness as that of the conventional shadow mask.

According to a still another aspect of the invention, a method of manufacturing a cathode ray tube comprises: preparing a substantially rectangular flat mask formed with a number of electron beam passage apertures; forming a mask body by subjecting the flat mask to plastic deformation into a cylindrical shape which has an infinitely large radius of curvature along the long axis and curved along the short axis; subjecting the plastically-deformed mask body to an elastic deformation in such a manner as to make the radius of curvature along the short axis larger than at the time of plastic deformation; and fixing the peripheral edge of the elastically-deformed mask body to the frame.

The above-mentioned manufacturing method can produce a shadow mask having a high strength of holding a curved surface in view of the fact that the mask body is fixed on the frame under a stress applied thereto in such a direction that the radius of curvature of the mask body along the short axis is reduced.

BRIEF DESCRIPTION OF DRAWINGS

FIGS. 1 to 7 show a color cathode ray tube according to a first embodiment of the present invention, in which:

FIG. 1 is a sectional view of the color cathode ray tube;

FIG. 2 is a perspective view schematically showing the outer geometry of a face panel of the color cathode ray tube according to a first actual example;

FIG. 3 is a sectional view taken along the X axis of the face panel;

FIG. 5 is a perspective view schematically showing the shape of the outer surface of a face panel according to a second actual example;

FIG. 6 is a sectional view taken along the Y axis of a face panel according to a third actual example;

FIG. 7 is a perspective view showing a part of a face panel according to a fourth actual example; and FIGS. 8 to 17B show a color cathode ray tube according to a second embodiment of the present invention, in which:

FIG. 8 is a sectional view of the color cathode ray tube;

FIG. 9 is a perspective view schematically showing the shape of a face panel according to a first actual example of the color cathode ray tube;

FIG. 10 is a sectional view taken along the X axis of the face panel;

FIG. 12 is a sectional view taken in the Y axis of a face panel according to a third actual example;

FIG. 13 is a perspective view showing a part of a face panel according to a fourth actual example;

FIG. 14 is a perspective view schematically showing the whole structure of the shadow mask;

FIG. 15 is a plan view showing a mask body of the shadow mask;

FIG. 16 is a sectional view taken along the long axis of the shadow mask;

FIG. 17B is a sectional view of the shadow mask cut away along line XVII—XVII in FIG. 14.

DETAILED DESCRIPTION OF THE PREFERRED EMBODIMENT

A color cathode ray tube according to a first embodiment of the invention will be explained with reference to the accompanying drawings.

Figure 1:
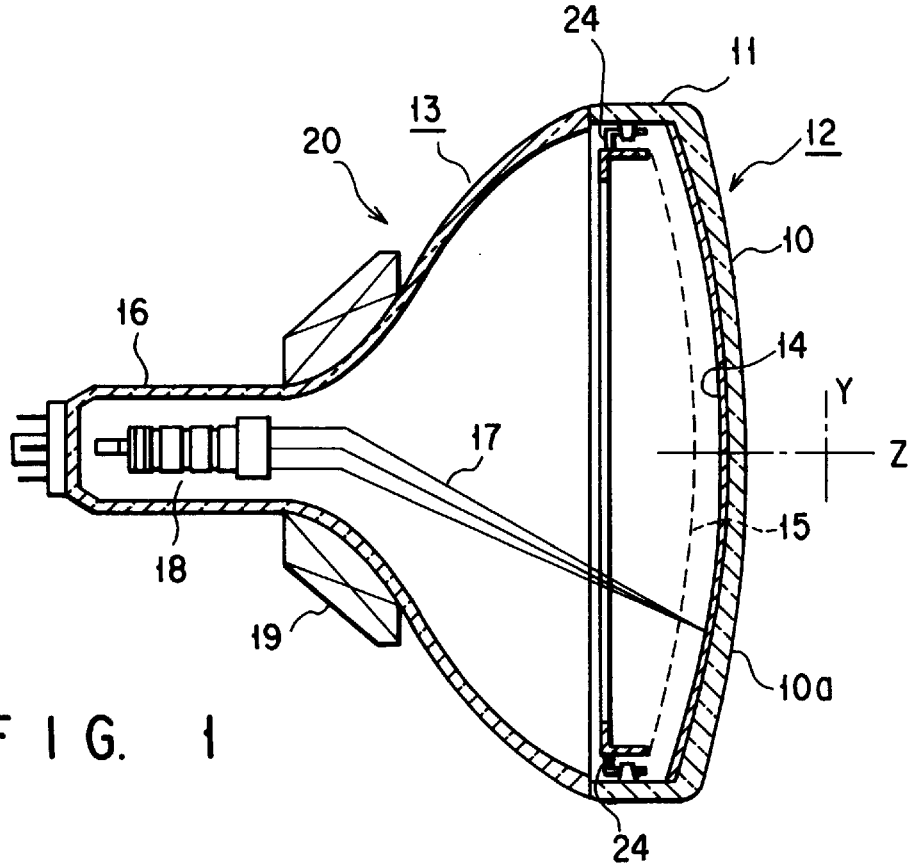

As shown in FIG. 1, a color cathode ray tube is configured with a vacuum envelope 20 including a substantially rectangular face panel 12 made of glass and a funnel 13 of glass coupled to the face panel. The face panel 12 has a substantially rectangular effective area 10 with a curved surface described below and a skirt 11 erected along the peripheral edge of the effective area. The funnel 13 is coupled to the skirt.

On the inner surface of the effective area 10 of the face panel 12 is formed a phosphor screen 14 having three color phosphor layers of blue, green and red. Also, a shadow mask 15 is arranged in the vacuum envelope 20 to face the phosphor screen 14. The shadow mask 15 is supported on the skirt 11 of the face panel 12 by means of a plurality of holders 20.

An electron gun 18 for emitting three electron beams 17 is arranged in the neck 16 of the funnel 13. The three electron beams 17 emitted from the electron gun 18 are deflected by a magnetic field generated by a deflector 19 mounted on the outside of the funnel 13, and scan the phosphor screen 14 horizontally and vertically through the shadow mask 15, thereby displaying a color image.

Figure 2:
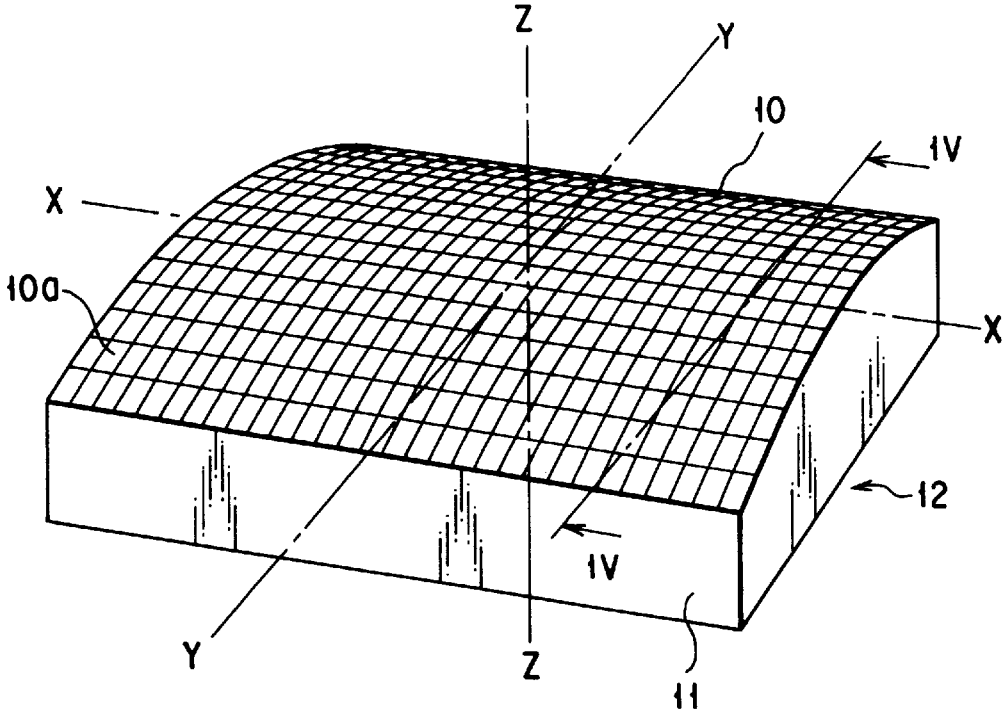

As shown in FIGS. 1 and 2, the effective area 10 of the face panel 12 is formed in a laterally long rectangle which has a long axis (X axis) perpendicular to the tube axis Z and extending in the horizontal direction and a short axis (Y axis) perpendicular to the long axis and tube axis and extending in the vertical direction. In FIG. 2, the outer surface 10*a* of the effective area 10 is shown with a multiplicity of matrix lines to define the shape thereof clearly.

Figure 3:
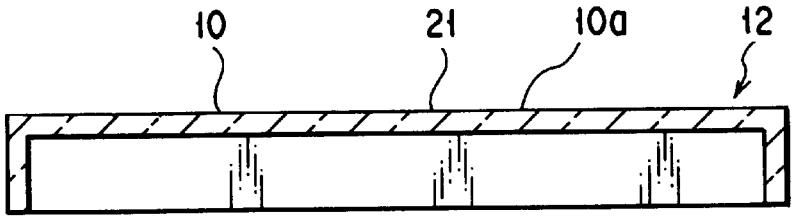
Figure 4A:
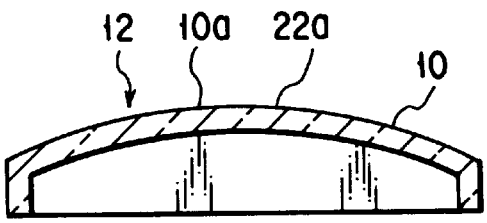
FIGS. 4A and 4B are sectional views of a face panel taken along the Y axis and line IV—IV in FIG. 2.
Figure 4B:
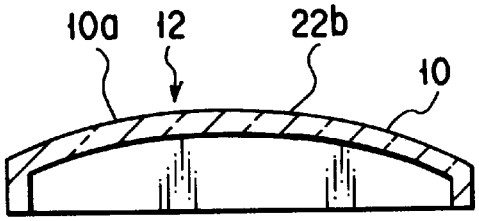

As shown in FIGS. 2 to 4B, the outer surface 10*a* of the effective area 10 is formed as a cylindrically curved surface having a center axis parallel to the long axis X. Specifically, the outer surface 10*a* of the effective area 10, as shown by line 21 in FIG. 3, is formed as a curved surface having an infinitely large radius of curvature along the long axis (X axis) as shown by straight line A in FIG. 3 and a radius of curvature along the short axis (Y axis) in such a manner that the radius of curvature on the short axis Y and on an arbitrary line IV—IV parallel to the short axis assume a predetermined value, as shown by curves 22*a*, 22*b* in FIGS. 4A and 4B.

In a color cathode ray tube having a substantially rectangular effective area 10 with the lateral length larger than the longitudinal length, the shape of the curved surface shown in FIG. 2 has the largest average radius of curvature as far as the diagonal average radius of curvature determined by the fall of the diagonal corners remains the same. The average radius of curvature K represents the sum of the minimum radius of curvature (1/Rmin) and the maximum radius of curvature (1/Rmax) and is given as $$K=1/\mathrm{Rmax}+1/\mathrm{Rmin} \quad (1)$$

where Rmax is the maximum radius of curvature and Rmin the minimum radius of curvature among the various radii of curvature in all the directions at an arbitrary point on the outer surface 10*a* of the effective area 10.

The atmospheric strength of the vacuum envelope 20 is determined by the geometry of the outer surface and the inner surface of the face panel 12. Another important factor of determining the atmospheric strength of the vacuum envelope is the average radius of curvature K. Also, the sum of the square of the minimum radius of curvature (1/Rmin) and the square of the maximum radius of curvature (1/Rmax) shown in equation (2) below is still another indicator for determining the atmospheric strength of the vacuum envelope.

$$(1/\mathrm{Rmax})^2+(1/\mathrm{Rmim})^2 \quad (2)$$

The effective area 10 having the shape of the curved surface shown in FIG. 2 permits both equations (1) and (2) to assume a maximum value for all shapes of curved surface and thus to improve the strength of the face panel 12. As a result, a strength equivalent to other face panels in common use can be secured even after improving the flatness of the face panel 12. It is thus possible to flatten the face panel 12 without increasing the thickness of the face panel 12, without attaching a reinforcing film to the outer surface 10*a* of the effective area 10 of the face panel or without taking any other measure for reinforcing the face panel 12. The successful flattening of the face panel contributes to a configuration of a color cathode ray tube having a higher atmospheric strength and an improved visibility.

A few actual examples of the invention will be explained.

ACTUAL EXAMPLE 1

Explanation will be made about an actual example 1 of a face panel including the above-described curved outer surface applied to a color cathode ray tube having an effective area with an aspect ratio of 16:9 and a diagonal length of 66 cm constituting the main stream of the cathode ray tubes commercially available in recent years.

Generally, an index R is used to indicate the flatness of the face panel as an expression based on the ratio between the diagonal average radius of curvature and the diagonal length of the effective area multiplied by a factor of 1.7. The color cathode ray tubes commercially available now have flattened the index R to about 2.0R. In the case of the index R of 2.0R, the diagonal average radius of curvature is R2244. The fall at the diagonal corners thus is 24.4 mm.

In contrast, the face panel 12 as shown in FIG. 2, has a surface 10*a* and effective area 10 that is configured of a cylindrical curved surface having an infinitely large radius of curvature along the long axis X and a predetermined radius of curvature along the short axis Y. The flatness of the outer surface 10*a* of the effective area 10 is 2.0R.

Table 1 shows the characteristics including the radius of curvature, the average radius of curvature, etc. of the outer surface 10*a* of the effective area 10 of the face panel 12 of the color cathode ray tube according to the actual example 1 in comparison with a face panel having a spherical outer surface (reference 1) and a face panel having a cylindrical outer surface with an infinitely large radius of curvature along the short axis Y and a predetermined radius of curvature along the long axis X (reference 2).

TABLE 1

| | Actual Example 1 | Reference 1 | Reference 2 |
|---|---|---|---|
| R index | 2.0R | 2.0R | 2.0R |
| Average radius of curvature at diagonal corners | R2244 | R2244 | R2244 |
| Fall of diagonal corners | 24.4 | 24.4 | 24.4 |
| Max. radius of curvature | ∞ | R2244 | ∞ |
| Min. radius of curvature | R549 | R2244 | R1707 |
| Average curvature | $1.82 \times 10^{-3}$ | $8.91 \times 10^{-4}$ | $5.86 \times 10^{-4}$ |

As clear from Table 1, the outer surface 10*a* of the effective area 10, exhibits different appearances depending on the shape of the curved surface, and has a substantially equal flatness for the same diagonal average radius of curvature. The actual example 1 has the same index R of 2.0R as the references 1 and 2 as a flatness determined by the diagonal average radius of curvature of the effective area 10 as described above. As compared with the references, however, this example has a considerably large average radius of curvature and a large sum of squares of the radius of curvature. This is because the face panel 12 according to the actual example 1 is laterally elongate with an aspect ratio of 16:9.

Because the average radius of curvature and the sum of squares of the radius of curvature constitute indexes for determining the atmospheric strength of the vacuum envelope, a face panel that has such a large average radius of curvature and a large sum of the squares of the radius of curvature maintains a considerably large strength of the vacuum envelope as compared with the face panels of references 1 and 2.

Although the actual example 1 shows the case wherein the strength of the face panel is increased relative to the conventional face panels, the thickness of the panel according to the actual example 1 can be decreased arbitrarily to about the same strength as the conventional face panels.

ACTUAL EXAMPLE 2

An actual example 2 will be explained with reference to the case in which the outer surface having the above-described shape is applied to a face panel having an effective area with an aspect ratio of 16:9 and a diagonal length of 66 cm as in the actual example 1. The actual example 2, however, has the same average radius of curvature as the reference 2.

Table 2 shows the characteristics, such as the radius of curvature, and the average radius of curvature of the face panel according to the actual example 2 as compared with those of the references 1 and 2.

TABLE 2

| | Actual Example 2 | Reference 1 | Reference 2 |
|---|---|---|---|
| R index | 6.3R | 2.0R | 2.0R |
| Average radius of curvature at diagonal corners | R7084 | R2244 | R2244 |
| Fall of diagonal corners | 7.69 | 24.4 | 24.4 |
| Max. radius of curvature | ∞ | R2244 | ∞ |
| Min. radius of curvature | R1707 | R2244 | R1707 |
| Average curvature | $5.86 \times 10^{-4}$ | $8.91 \times 10^{-4}$ | $5.86 \times 10^{-4}$ |
| Sum of squares of radius of curvature | $3.43 \times 10^{-7}$ | $3.97 \times 10^{-7}$ | $3.43 \times 10^{-7}$ |

As shown in Table 2, the face panel according to the actual example 2 has the same average radius of curvature and the same sum of squares of radius of curvature as the second reference. The reference 2 has a radius of curvature of R1707 along the long axis and an infinitely large radius of curvature along the short axis. In contrast the face panel according to the actual example 2 has an infinitely large radius of curvature along the long axis and a radius of curvature of R1707 along the short axis.

As described above, the face panel according to the actual example 2 has the same average radius of curvature as the reference 2. With its aspect ratio of 16:9, however, the actual example 2 has a fall at the diagonal corners considerably different from the reference 2 and has a remarkably improved flatness of 6.3R as compared with the figure 2.0R of the reference 2.

Figure 5:
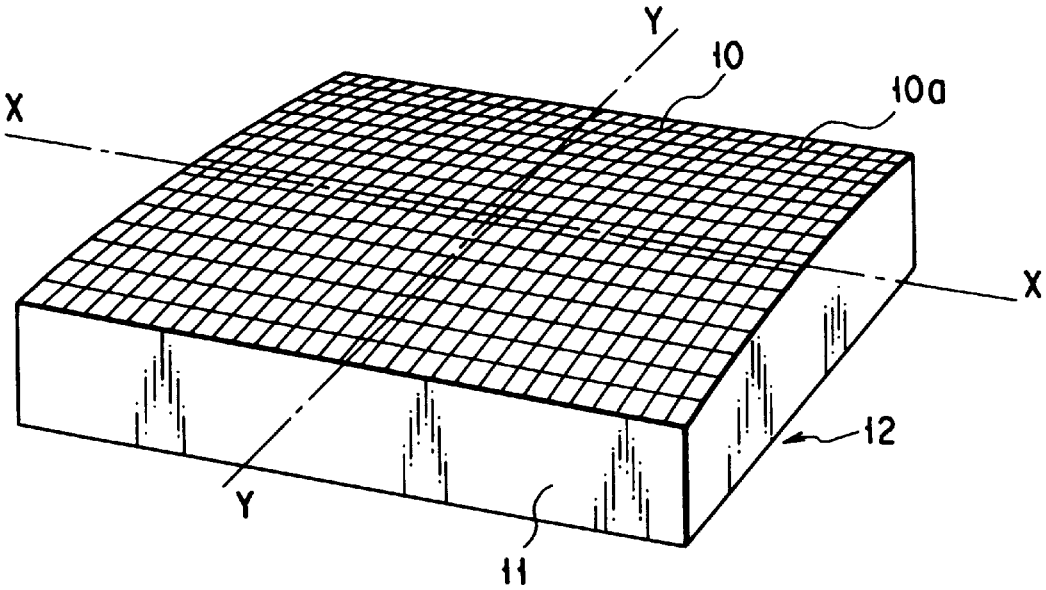

FIG. 5 shows the geometry of the outer surface 10*a* of the effective area of the face panel 12 corresponding to the actual example 2. The outer surface 10*a* of the effective area 10 has the same average radius of curvature as the reference 2 but an apparently different flatness with a remarkably improved over the reference 2. Also, as seen from Table 2, the flatness of the outer surface of the effective area is determined not by the average radius of curvature but substantially by the diagonal average radius of curvature depending on the fall at the diagonal corners.

The vacuum envelope of the color cathode ray tube is fabricated by first coupling the face panel of glass to the funnel of glass and then exhausting the air from the interior of the envelope into a vacuum state. The pressure difference between inside and outside caused by the vacuum develops a deformation and an internal stress of the vacuum envelope. In order to alleviate this internal stress, the vacuum envelope is reinforced by a metal reinforcing band. Even the reinforcing band, however, cannot completely alleviate the internal stress of the vacuum envelope.

The atmospheric strength of the vacuum envelope, which depends to a large measure on the shape and the thickness thereof, is also affected by the shape of the outer surface of the face panel. Generally, the larger the average curvature of the outer surface of the effective area, the larger the atmospheric strength. The face panel according to the actual example 2 has a remarkably improved flatness as compared with the reference 2 but the same average radius of curvature as the reference 2, resulting in substantially the same atmospheric strength as that of the reference 2.

ACTUAL EXAMPLE 3

A face panel according to an actual example 3 is configured with an outer surface of the effective area having an infinitely large radius of curvature along the long axis X and a constant sectional shape for every point of the effective area in a plane parallel to the plane containing the short axis Y and the tube axis. Further, the same sectional shape is not arcuate having a single radius of curvature like the actual examples, but provides a curved surface expressed by a high-order polynomial.

Specifically, the outer surface of the effective area is curved as to be expressed by $Z=\Sigma a_i Y^{2i}$, where a is a coefficient and i=0, 1, 2, . . . ,n in a coordinate system having an origin at the center of the outer surface of the face panel, a long axis along the X axis, a short axis along the Y axis and a tube axis along the Z axis with the skirt end (junction with the funnel) of the face panel down.

More specifically, according to the actual example 3, the outer surface of the effective area is formed in the shape given by the formulae below, assuming that n=2.

$$Z=a1Y^2+a2Y^4$$

$$a1=-2.350\times10^{-4}$$

$$a2=-2.245\times10^{-9}$$

This face panel is equivalent to the face panel of the actual example 2 with a slightly larger radius of curvature of the peripheral portion of the effective area and including the second-order components of 80% and the fourth-order components of 20%. The face panel has an outer shape given as $$Z=-2.350\times10^{-4}Y^2-2.245\times10^{-9}Y^4$$

Figure 6:
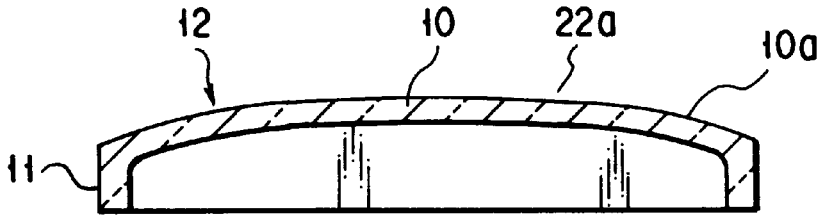

Thus, the sectional shape with the effective area cut away in a plane containing the short axis Y and the tube axis Z, i.e., the sectional shape along the short axis, is as shown by a curve 22*a* in FIG. 6. The same curved surface is shared by the sectional shape obtained with the effective area cut away in a plane parallel to the plane containing the short axis Y and the tube axis Z. The diagonal average radius of curvature dependent on the fall at the diagonal corners of this face panel is 6.3R.

Assume that the outer surface of the effective area is curved as described above. As clearly seen from FIG. 6, the radius of curvature in the direction of the short axis Y in the neighborhood of the long axis X of the effective area can be slightly increased, and the radius of curvature in the neighborhood of the long side of the effective area can be slightly decreased. As a result, it is possible to improve the strength of the vacuum envelope which generally has a lower strength at the peripheral portion than at the central portion of the effective area.

ACTUAL EXAMPLE 4

In the face panels according to the actual examples 1 and 2, the effective surface has a cylindrically curved outer surface with an infinitely large radius of curvature along the long axis X and a predetermined radius of curvature along the short axis Y. In the actual example 4, on the other hand, the face panel of the second actual example is slightly modified to have an outer surface with a slight radius of curvature along the long axis X as shown by a curve 24 in FIG. 7 due to the manufacturing problems, etc. Also, the radius of curvature of the outer surface of the effective area along the short axis is slightly different between the portion on the short axis and in the neighborhood of the short side, as shown by a curve 25*a* for a portion on the short axis Y and by a curve 25*b* for a portion in the neighborhood of the short side of the effective area.

Figure 7:
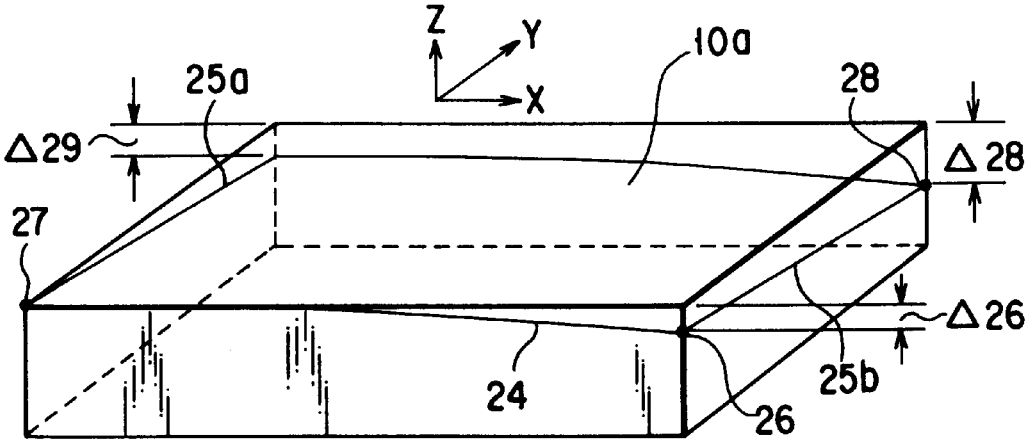

More specifically, as shown in Table 3, the outer surface of the effective area has a radius of curvature of R41363 along the long axis X in such a manner as to secure the fall Δ26 of 1 mm at the end 26 of the long axis X. Also the radius of curvature along the short axis Y is slightly smaller on the short side of the effective area than on the short axis Y. In FIG. 7, the central portion of the outer surface 10*a* of the effective area is designated by reference numeral 27, the diagonal corner by numeral 28, the fall at the diagonal corner by Δ28, and the fall at the end of the short axis Y by numeral Δ29.

TABLE 3

| | Actual Example 4 | Actual Example 2 |
|---|---|---|
| Index R | 6.3R | 6.3R |
| Average radius of curvature at diagonal corners | R7084 | R7084 |
| Fall Δ 28 at diagonal corners | 7.69 | 7.69 |
| Radius of curvature along long axis | R41363 | ∞ |
| Fall Δ 26 at long axis end | 1 | 0 |
| Radius of curvature along short axis | R2303 | R1707 |
| Fall Δ 29 at short axis end | 5.69 | 7.69 |
| Radius of curvatures of long side | R20682 | ∞ |
| Radius of curvature of short side | R1960 | R1707 |
| Radius of curvature of central portion | $4.58 \times 10^{-4}$ | $5.86 \times 10^{-4}$ |
| Radius of curvature of diagonal corners | $5.96 \times 10^{-4}$ | $5.86 \times 10^{-4}$ |

The outer surface of the effective area of the face panel curved as described above does not constitute a cylindrically curved surface and the average radius of curvature is reduced at both the central portion 27 and the diagonal corners 28. The basic curved form, however, suits the geometric requirement of a curved surface according to the present invention, so that the atmospheric strength of the vacuum envelope of this example is substantially equivalent to that of other examples described above.

A face panel with an equal effect can be obtained also by modifying the face panel of the actual example 3 in the same manner as the actual example 4 is modified in the curve of the outer surface of the effective area.

A few actual examples were explained above. The outer surface of the effective area of the face panel of the cathode ray tube according to the invention, however, is not limited to a cylindrically curved surface or the one expressed by a polynomial. For example, the atmospheric strength of the face panel can be improved relative to a face panel having the conventional outer surface, even when the outer surface has a radius of curvature more than that of the actual example 2 or a radius of curvature intermediate between the actual examples 1 and 2, as far as the flatness is the same.

Although the actual example 3 refers to a curved surface expressed by a high-order polynomial, say, a fourth-order function, the invention is not limited to such a curved surface but is applicable to a curve adjusted in accordance with the desired characteristics by a formula including fourth- or higher-order polynomial.

The inner surface of the effective area of the face panel can be set to an arbitrary curve regardless of the shape of the outer surface.

Then, a color cathode ray tube according to a second embodiment of the invention will be described in detail.

A general configuration of the color cathode ray tube is identical to that of the color cathode ray tube according to the first embodiment described above. The same component parts in this embodiment as the corresponding ones in the first embodiment are designated by the same reference numerals, respectively, and will not be described in detail. The second embodiment is different from the first embodiment in the shape of the effective area 10 of the face panel 12. The configuration of the face panel 12 will be described in detail.

As shown in FIGS. 8 to 11B, the face panel 12 includes a substantially rectangular effective area 10, the outer surface 10*a* of which is formed substantially flat with a substantially infinitely large radius of curvature along both the long axis X (horizontal direction) and the short axis (vertical direction). As compared with the substantially flat outer surface 10*a*, the inner surface 10*b* of the effective area 10, as shown in a sectional view taken along the long axis X in FIG. 10, has a substantially infinitely large radius of curvature along the long axis X and, as shown in a sectional view taken along the short axis Y in FIG. 11A, is formed into a cylindrically curved surface having a predetermined radius of curvature along the short axis Y.

On the basis of the shape of the effective area 10 described above, the outer surface 10*a* of the effective area may be curved with a slight curvature along the short axis Y, and the inner surface 10*b* of the effective area 10 can be arbitrarily curved with a slight radius of curvature along the long axis X.

In the face panel 12 including the substantially flat outer surface 10*a* and the curved inner surface 10*b* of the effective area 10 with the above-mentioned configuration, the thickness of the peripheral portion of the effective area is determined in accordance with the curvature of the inner surface 10*b*. In the color cathode ray tube in which the length of the effective area 10 along the long axis X is larger than the length along the short axis Y, i.e., the lateral length is larger than the longitudinal length, the inner surface 10*b* of the effective area 10 can be curved with the largest average curvature if the inner surface of the face panel 12 has the same fall at the diagonal corners and the thickness of the face panel is the same at the diagonal corners.

The average curvature K is defined as the sum of the minimum radius of curvature (1/Rmax) and the maximum radius of curvature (1/Rmim) and given as $$K=1/\mathrm{Rmax}+1/\mathrm{Rmim} \quad (3)$$

where Rmax is the maximum radius of curvature and Rmim is the minimum radius of curvature in all the directions at an arbitrary point on the inner surface 10*b* of the effective area.

The atmospheric strength of the vacuum envelope 20 is determined by the shape of the outer surface and the inner surface of the face panel 12. With the face panel 12 having a substantially flat outer surface 10*a* of the effective area 10, the average radius of curvature K of the inner surface 10 constitutes one of the crucial factors for determining the atmospheric strength of the vacuum envelope. Also, the sum of the squares of the minimum radius of curvature (1/Rmax) and the maximum radius of curvature (1/Rmim) shown in equation (4) below is another indicator for determining the atmospheric strength of the vacuum envelope.

$$(1/\mathrm{Rmax})^2+(1/\mathrm{Rmim})^2 \quad (4)$$

Figure 9:
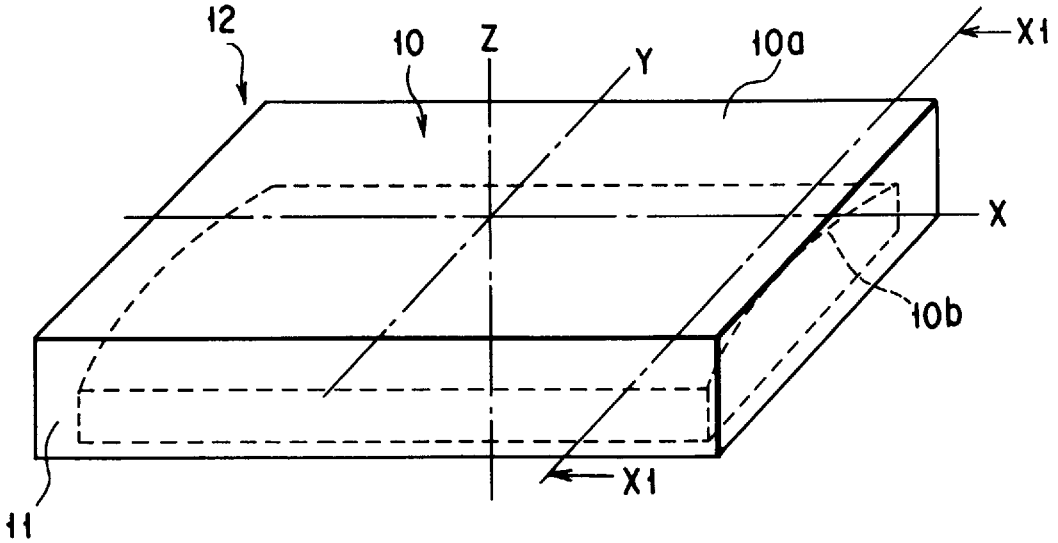

The effective area 10 having the curved surface as shown in FIG. 9, with which the values of equations (3) and (4) can be maximized for all curves, can improve the strength of the face panel 12. Even in the case where the flatness of the face panel 12 is improved, therefore, a strength equivalent to that of other face panels now in common use can be secured. For this reason, the face panel can be flattened without taking any reinforcing measures such as thickening the face panel 12 or attaching a reinforcing film on the outer surface 10*a* of the effective area of the face panel. The successful flattening can configure the color cathode ray tube with a higher atmospheric strength and an improved visibility.

A few actual examples will be explained below.

ACTUAL EXAMPLE 1

An actual example 1 will be explained with reference to the case in which the present embodiment is applied to a color cathode ray tube having an aspect ratio of 16:9 and a diagonal length of 66 cm constituting the recent main stream of the color cathode ray tubes.

The face panel used in the actual example 1 has a substantially flat outer surface of the effective area as shown in FIGS. 9 to 11*b,* and the inner surface 10*b* of the effective area is configured of a cylindrical curve with an infinitely large radius of curvature along the long axis X and a single radius of curvature along the short axis Y.

Figure 11A:
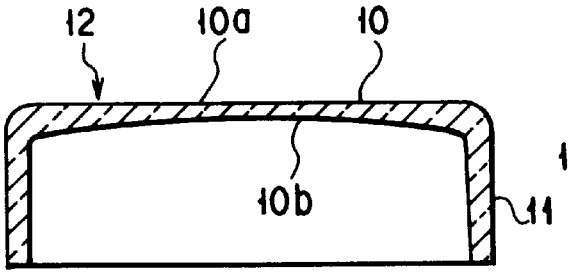
FIGS. 11A to 11B are sectional views of the face panel taken along the Y axis and a line XI—XI in FIG. 9, respectively.
Figure 11B:
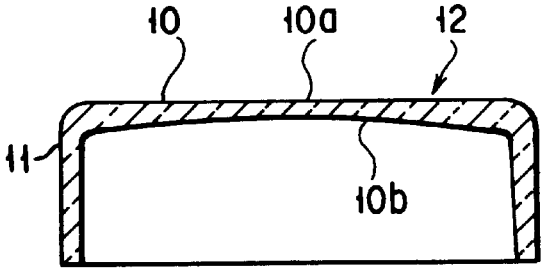

Specifically, as shown in FIG. 11A, the outer surface 10*a* of the effective area 10 has an infinitely large radius of curvature along the short axis Y and only the inner surface 10*b* has a predetermined radius of curvature along the short axis Y. The thickness of the face panel 12 is maximum at the end of the short axis Y. The sectional view of the inner surface 10*b* of the face panel 12 along the direction parallel to the short axis Y, as shown in FIG. 11A, is arcuate, while the sectional view of the inner surface of the face panel along the line XI—XI parallel to the short axis Y has the same arcuate form as that on the short axis Y as shown in FIG. 11B.

Figure 10:
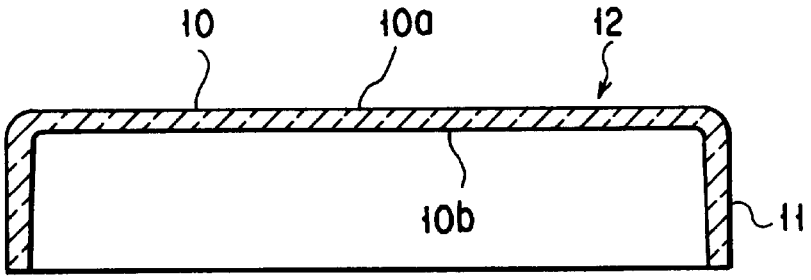

As shown in FIG. 10, the radius of the curvature of the inner surface and the outer surfaces 10*b,* 10*a* of the effective area 10 along the long axis X are both infinitely large, so that the thickness of the face panel 12 is substantially constant along the long axis X.

Table 4 shows the characteristics including the radius of curvature and the average radius of curvature of the inner surface 10*b* of the effective area of the face panel 12 of a color cathode ray tube according to the actual example 1, as compared with those of a face panel having a spherical inner surface (reference 1) and those of a face panel having a cylindrical inner surface (reference 2) with an infinitely large radius of curvature along the short axis and a predetermined radius of curvature along the long axis. In the actual example 1, the outer surface 10*a* of the effective area 10 is assumed to be formed substantially flat.

The actual example 1 and the references 1 and 2 have a thickness difference of 7 mm between the central portion and the diagonal corners of the face panel (this difference constitutes the fall at the diagonal corners of the inner surface of the panel). Only the shape of the inner surface is different between the actual example 1 and the references 1 and 2.

TABLE 4

| | Actual Example 1 | Reference 1 | Reference 2 |
|---|---|---|---|
| Index R for inner surface | 6.9R | 6.9R | 6.9R |
| Average radius of curvature at diagonal corners of inner surface | R7782 | R7782 | R7782 |
| Diagonal corner fall of inner surface | 7 | 7 | 7 |
| Max. radius of curvature | ∞ | R7782 | ∞ |
| Min. radius of curvature | R1873 | R7782 | R5912 |
| Average radius of curvature | $5.34 \times 10^{-4}$ | $2.57 \times 10^{-4}$ | $1.69 \times 10^{-4}$ |
| Sum of squares of radius of curvature | $2.85 \times 10^{-7}$ | $3.30 \times 10^{-8}$ | $2.86 \times 10^{-8}$ |

As clearly seen from Table 4 above, in the face panel according to the actual example 1, the fall at the diagonal corners of the inner surface of the panel is the same as that of the references 1 and 2. Nevertheless, the average radius of curvature of the inner surface of the effective area is remarkably large with a larger sum of the squares of the radius of curvature. This difference conspicuously presents itself with the face panel of the actual example 1 which has a great difference between the lateral and longitudinal lengths as indicated by the aspect ratio of 16:9.

As described above, the atmospheric strength of the vacuum envelope is affected by the average radius of curvature and the sum of squares of the radius of curvature of the face panel. Generally, the larger these values, the higher the atmospheric strength of the vacuum envelope. Consequently, the face panel according to the actual example 1, as compared with the references 1 and 2, can have a considerably larger atmospheric strength of the vacuum envelope.

The conventional face panels having a flat outer surface of the effective area never has an inner surface of the effective area curved like that of the actual example 1. As a result, the color cathode ray tube of the actual example 1, as compared with the conventional face panel, can advantageously have an improved atmospheric strength of the vacuum envelope. In this color cathode ray tube, therefore, the atmospheric strength can be increased to the desired level with a lesser reinforcement such as thickening of the face panel.

ACTUAL EXAMPLE 2

An actual example 2 will be explained with reference to the case in which the shape of the inner surface described above is applied to the face panel having an aspect ratio of 16:9 and a diagonal length of 66 cm, as in the actual example 1. The actual example 2, however, has the same average radius of curvature as the second reference.

Table 2 shows the characteristics such as the radius of curvature and the average radius of curvature of the inner surface of the effective area of the face panel according to the actual example 2, as compared with those of the actual example 1 and the reference 2.

TABLE 5

| | Actual Example 2 | Actual Example 1 | Reference 2 |
|---|---|---|---|
| Index R for inner surface | 22.0R | 6.9R | 6.9R |
| Average radius of curvature at diagonal corners of inner surface | R24639 | R7782 | R7782 |
| Diagonal corner fall of inner surface | 2.2 | 7 | 7 |
| Max. radius of curvature | ∞ | ∞ | ∞ |
| Min. radius of curvature | R5912 | R1873 | R5912 |
| Average radius of curvature | $1.69 \times 10^{-4}$ | $5.34 \times 10^{-4}$ | $1.69 \times 10^{-4}$ |
| Sum of squares of radius of curvature | $2.86 \times 10^{-8}$ | $2.85 \times 10^{-7}$ | $2.86 \times 10^{-8}$ |

As seen from Table 5, the face panel 12 of the actual example 2 has the same average radius of curvature and the same sum of squares of the radius of curvature of the inner surface of the effective area as those of the reference 2. In the reference 2, the radius of curvature along the long axis of the inner surface is R5912 and the radius of curvature along the short axis is infinitely large. Conversely, with the actual example 2, the radius of curvature along the long axis of the inner surface is infinitely large, while the radius of curvature along the short axis thereof is R5912. With the face panel of the actual example 2, the average radius of curvature is the same as that of the reference 2, but due to the aspect ratio of 16:9 of the effective area, has a considerably different fall at the diagonal corners of the inner surface from that of the reference 2, so that the actual example 2 can remarkably reduce the difference in thickness between the central portion and the peripheral portion of the face panel 12. As a consequence, the difference of light transmittance between outside and inside the effective area 10 can be reduced for an improved uniformity of the displayed images. Further, in the face panel 12 of the actual example 2, the panel reinforcement required for flattening the outer surface of the effective area, such as thickening of the face panel, can be minimized as in the case of the reference 2.

ACTUAL EXAMPLE 3

A face panel according to a actual example 3 has a substantially flat outer surface of the effective area and an inner surface of the effective area. The inner surface which has a substantially infinitely large radius of curvature along the long axis X and a fixed sectional view on a plane parallel to the plane containing the short axis Y and the tube axis Z for any point in the effective area. In addition, the sectional view of the face panel of the actual example 3 is not arcuate having a single radius of curvature like those of the actual examples 1 and 2, but is curved as expressed by a high-order polynomial.

Specifically, the inner surface of the effective area constitutes a curved surface expressed by $Z=\Sigma a_i Y^{2i}$ where a is a coefficient and i=0, 1, 2 . . . ,n in a coordinate system with the end of the skirt 11 (junction with the funnel) of the face panel down, having a long axis as X axis, a short axis as Y axis and a tube axis as Z axis with an origin at the center of the inner surface of the face panel.

In particular, the inner surface of the effective area of the third actual example is formed in a manner satisfying the relation specified below, assuming n=2.

$$Z=a1Y^2+a2Y^4$$

$$a1=-2.139\times10^{-4}$$

$$a2=-2.919\times10^{-10}$$

This face panel, as compared with the face panel of the actual example 2, is equivalent to the case in which the radius of curvature of the peripheral portion of the effective area is slightly increased and configured of the second-order components of 80% and the fourth-order components of 20%. The shape of the inner surface of this face panel is given as $$Z=-2.139\times10^{-4}Y^2-2.919\times10^{-1}Y^4$$

Figure 12:
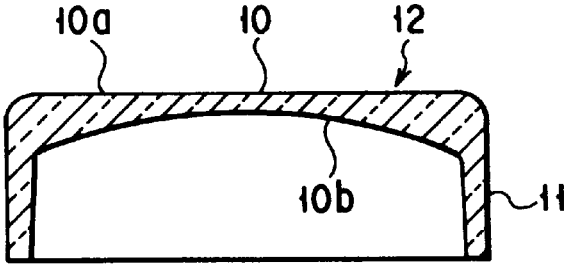

FIG. 12 is a sectional view of the effective area 10 cut away in a plane containing the short axis Y and the tube axis Z, i.e., a sectional view on the short axis, in the case where the fall at the diagonal corners of the inner surface 10*b* of the effective area 10 is 7 mm. The same curved surface is observed in a sectional view of the effective area 10 cut away in a plane parallel to the plane containing the short axis Y and the tube axis Z.

Assuming that the inner surface of the effective area 10 is as described above, as seen clearly from FIG. 12, the radius of curvature along the short axis Y in the neighborhood of the long axis X of the effective area can be increased while the radius of curvature in the neighborhood of the long side of the effective area can be slightly reduced. As a result, it is possible to improve the strength of the vacuum envelope generally having a lower strength at the peripheral portion than at the central portion of the effective area thereof.

ACTUAL EXAMPLE 4

In the face panel of the actual example 1, the outer surface 10*a* of the effective area 10 is substantially flat. A face panel of an actual example 4, on the other hand, has the same inner surface of the effective area as the face panel of the actual example 1, and a curved outer surface of the effective area with a small curvature along the short axis. Specifically, the outer surface of the effective area is cylindrically curved with an infinitely large radius of curvature along the long axis and a predetermined radius of curvature R6545 along the short axis. The fall at the diagonal corners of the outer surface of the effective area is 2 mm.

The face panel according to the actual example 4 having a configuration as described above, which is a slight modification from the face panel of the actual example 1 taking into consideration the problems encountered in manufacturing the face panel, can produce the substantially same function and effects as the face panel according to the actual example 1.

ACTUAL EXAMPLE 5

A face panel according to an actual example 5 is configured of a combined shape of the actual examples 3 and 4. Specifically, the outer surface of the effective area of the face panel is cylindrically curved with an infinitely large radius of curvature along the long axis and a small curvature along the short axis, while the inner surface of the effective area is curved in a form expressed by a high-order polynomial.

The face panel having this configuration can also produce substantially the same function and effects as the face panel of the actual example 4.

ACTUAL EXAMPLE 6

Figure 13:
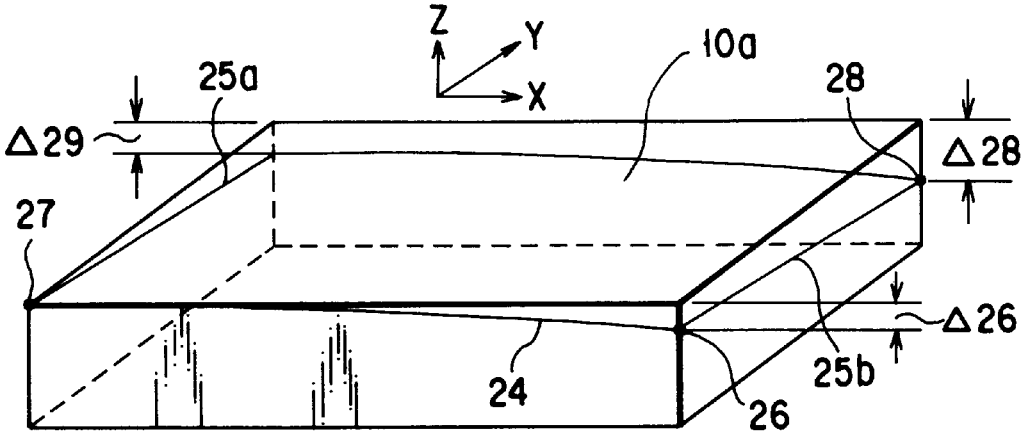

A face panel according to an actual example 6 has a substantially flat outer surface of the effective area and an inner surface not exactly cylindrically curved but with a slight curvature along the long axis. Specifically, as shown in FIG. 13, the radius of curvature is set to R41363 so as to secure the fall Δ26 of 1 mm at the end 26 of the long axis X of the inner surface.

Also, the radius of curvature along the short axis Y of the inner surface of the effective area 10 is slightly varied between a portion on the short axis and a portion in the neighborhood of the short side as indicated by a curve 25*a* and a curve 25*b*, respectively. In FIG. 13, the central portion of the inner surface 10*b* of the effective area is designated by reference numeral 27, the diagonal corners thereof by numeral 28, the fall at the diagonal corners by numeral Δ28, and the fall at the end of the short axis Y by numeral Δ29.

Table 6 shows the characteristics of a face panel according to the actual example 6 as compared with those of the face panel according to the actual example 1.

TABLE 6

| | Actual Example 6 | Actual Example 1 |
|---|---|---|
| Index R for inner surface | 6.9R | 6.9R |
| Average radius of curvature at diagonal corners of inner surface | R7782 | R7782 |
| Fall Δ 28 at inner surface diagonal corners | 7 | 7 |
| Radius of curvature along long axis | R41363 | ∞ |
| Fall Δ 26 at end of long axis | 1 | 0 |
| Radius of curvature along short axis | R2620 | R1873 |
| Fall Δ 29 at end of short axis | 5 | 7 |
| Radius of curvatures of long side | R20682 | ∞ |
| Radius of curvature of short side | R2184 | R1873 |
| Average radius of curvature of central portion | $4.06 \times 10^{-4}$ | $5.86 \times 10^{-4}$ |
| Average radius of curvature of diagonal corners | $5.06 \times 10^{-4}$ | $5.34 \times 10^{-4}$ |

The inner surface of the effective area of the face panel described above is not cylindrically curved, and therefore both the central portion 27 and the diagonal corners 28 are smaller in average radius of curvature. The basic geometry, however, is suited to the curved form intended by the invention, and the atmospheric strength of the vacuum envelope is also substantially equal to those of the above-mentioned actual examples.

A face panel having a similar effect can also be obtained by adding a modification similar to the actual example 6 to the basic curved structure of the face panel of the actual example 3.

A few actual examples of the second embodiment were explained above. The shape of the inner surface of the effective area of the face panel of the cathode ray tube according to the invention, however, is not limited to a cylindrically curved surface or a curved surface expressed by a polynomial. A face panel having a curved inner surface with a radius of curvature intermediate the actual examples 1 and 2 or a face panel having a curved inner surface with a radius of curvature not less than that of the actual example 2, for instance, can improve the atmospheric strength of the face panel having a conventional shape of the inner surface, as far as the peripheral portion of the effective area has the same thickness.

Also, apart from the curved surface expressed by a high-order polynomial, say, a fourth-order function according to the actual example 3, the invention is not limited to such a case, and it is possible to adjust the shape of the curved surface in accordance with the desired characteristics by a formula including a fourth- or higher-order polynomial.

The actual example 2 was explained above with reference to the case where the outer surface of the effective area of the face panel is substantially flat, and the case in which the outer surface is curved with a small radius of curvature along the short axis. Any shape of the outer surface, however, can be used as far as the visibility can be improved to achieve the object of the invention. Also, the outer surface of the effective area can be curved with a slight radius of curvature, and the inner surface of the effective area can be a combination of finely-adjusted curved surfaces but not an exactly cylindrical shaped, taking the manufacturing problems into consideration.

Figure 8:
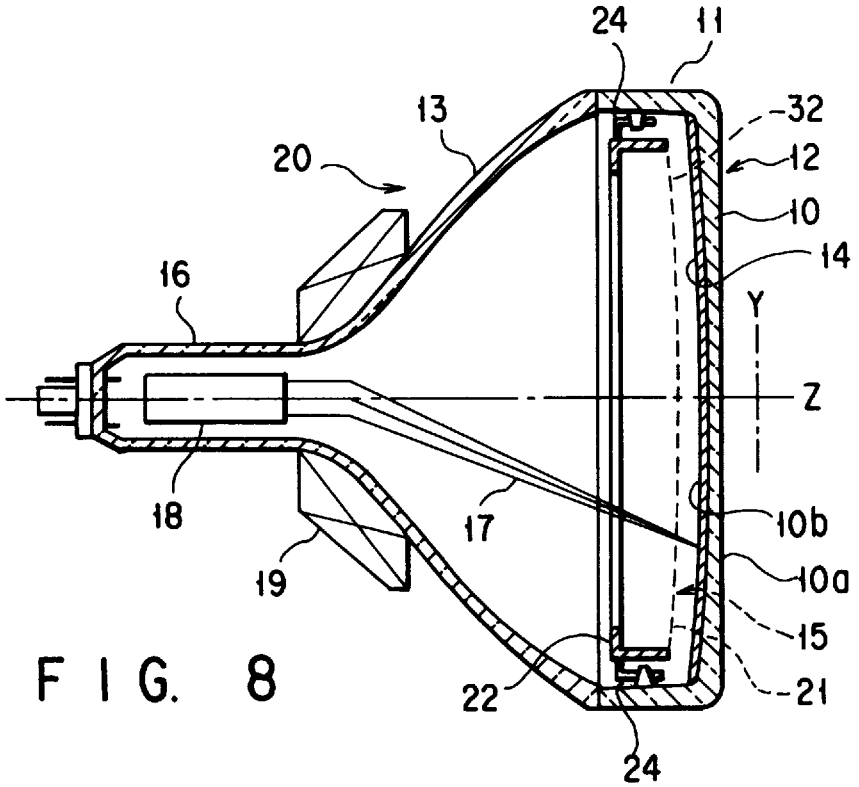
Figure 14:
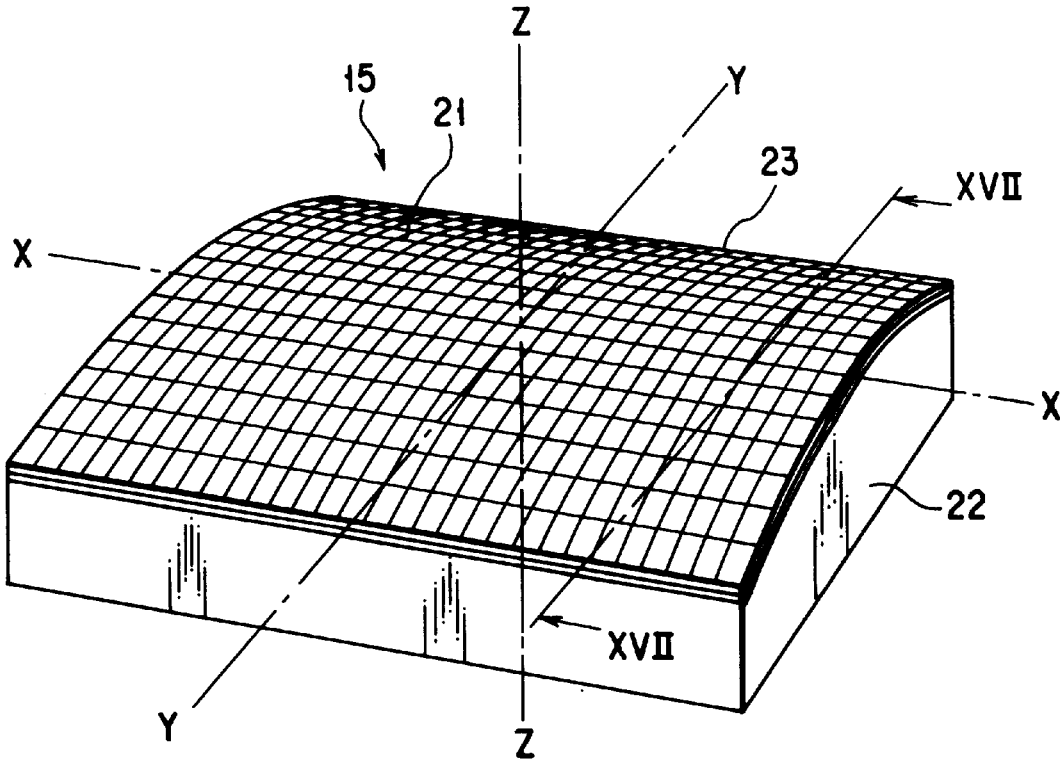
Figure 15:
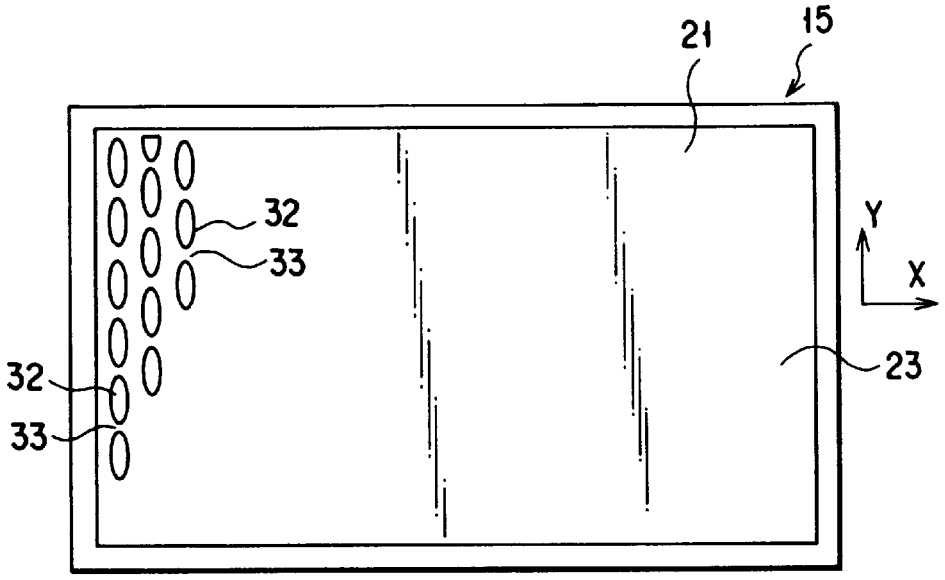
Figure 16:
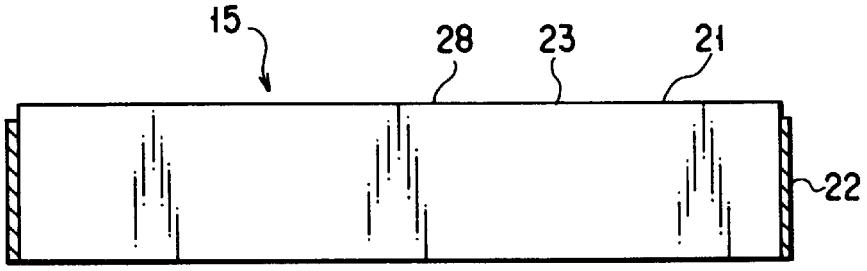
Figure 17A:
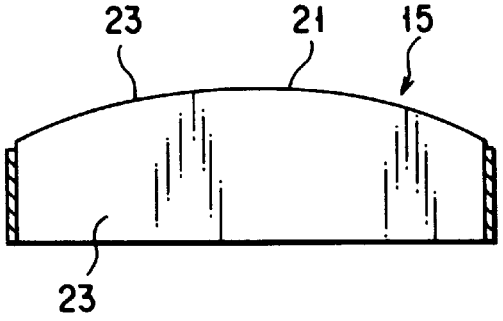
FIG. 17A is a sectional view cut away on the short axis of the shadow mask.
Figure 17B:
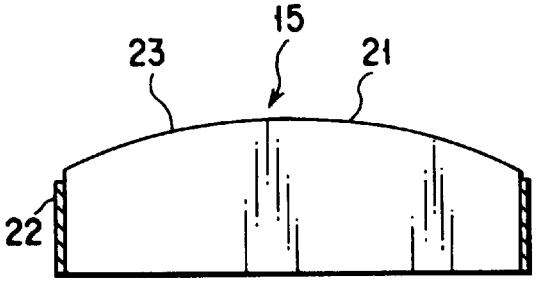

According to the second embodiment, as shown in FIGS. 8, 14 and 15, the shadow mask 15 includes a substantially laterally long rectangular mask body 21 arranged in opposed relation to the phosphor screen 14 formed on the inner surface of the effective area 10 of the face panel 12, and a substantially laterally long rectangular frame 22 supporting the peripheral edge portion of the mask body 21. The mask body 21 is formed with a number of electron beam passage apertures 32 arranged in a predetermined fashion. The frame 22 is supported on the skirt 11 of the face panel 12 through a plurality of holders 24.

The mask body 21 has a rectangular effective surface 23, which is formed as a curved surface having an infinitely large radius of curvature along the long axis X (horizontal direction) and having a predetermined curvature only along the short axis Y (vertical direction).

Specifically, as shown in FIGS. 14, 16 to 17B, the effective surface 23 is formed as a cylindrically curved surface with an infinitely large radius of curvature along the long axis X and a single radius of curvature fixed over the entire surface along the short axis Y, or as a curved surface with an infinitely large radius of curvature along the long axis X and a radius of curvature along the short axis Y expressed by a high-order polynomial.

In the shadow mask 15 having the effective surface 23 of a laterally long rectangle as described above, a curved surface with a maximum radius of curvature can be obtained by a curved surface having an infinitely large radius of curvature along the long axis X and a predetermined radius of curvature only along the short axis Y, as far as the fall at the diagonal corners and the flatness of the effective surface 23 are the same.

The strength of holding the curved surface of the shadow mask 15 is determined by the curve of the effective surface 23 of the mask body 21, the thickness of the mask body 21, the shape and size of the electron beam passage apertures 32 and the arrangement of the electron beam passage apertures. Assuming that the thickness of the mask body 21 and the shape, size and arrangement of the electron beam passage apertures 32 are constant, on the other hand, the strength of holding the curved surface is determined by the curve of the mask body.

One index for determining the strength of holding the curved surface of the shadow mask 15 is provided by the sum of the squares of the maximum radius of curvature 1/Rmax and the minimum radius of curvature 1/Rmim shown below.

$$1/Rmax^2+1/Rmim^2$$

With the shadow mask 15 having a surface curved only along the short axis Y with an infinitely large radius of curvature along the long axis X as described above, the average radius of curvature expressed as the sum of 1/Rmax and 1/Rmim and the sum of squares thereof can both be maximized of all the shapes of curved surfaces, resulting in an improved strength of holding the curved surface.

The shadow mask 15 described above further can facilitate the flattening of the face panel by improving the flatness thereof while maintaining the strength of holding the curved surface equivalent to the conventional shadow mask. Furthermore, the thickness of the shadow mask can be reduced while maintaining the same flatness as the conventional shadow mask.

Figure 18A:
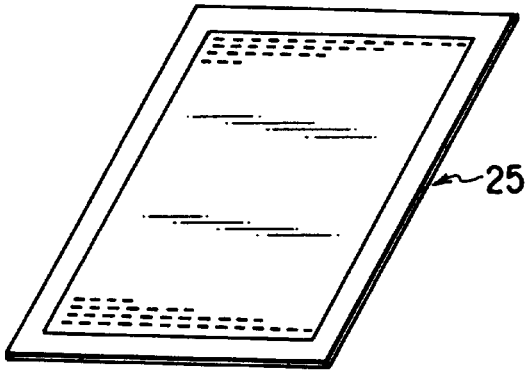
FIGS. 18A to 18D are perspective views schematically showing the steps of fabricating the shadow mask.
Figure 18B:
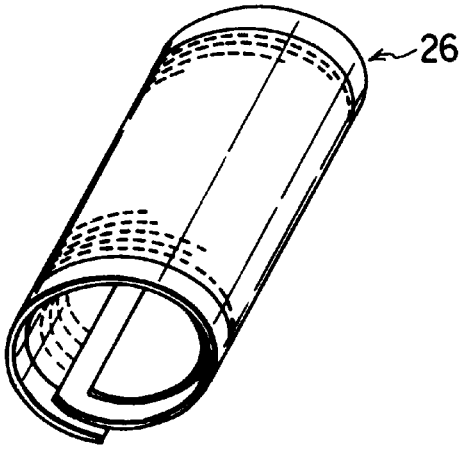

In manufacturing the mask body 21 of this shadow mask 15, as shown in FIG. 18A, a flat mask 25 formed with a number of electron beam passage apertures 32 in a predetermined arrangement by photoetching is prepared as in the ordinary shadow mask. Then, as shown in FIG. 18B, the flat mask 25 is rounded using a roller or the like so that the cylindrical mask 26 curved only along the short axis Y is subjected to plastic deformation.

Figure 18C:
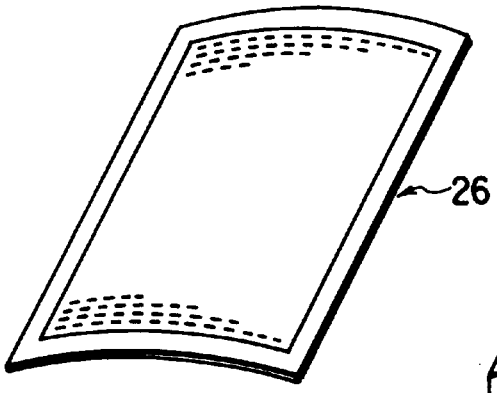
Figure 18D:
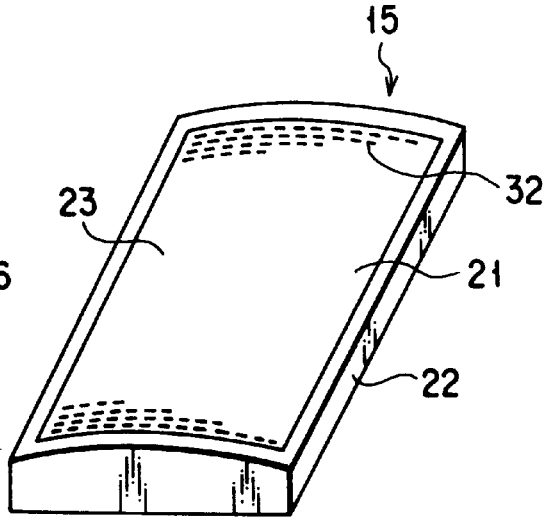

After that, as shown in FIG. 18C, the cylindrical mask 26 is subjected to an elastic deformation, and the radius of curvature thereof along the short axis Y is increased to the desired value described above. The peripheral edge of the mask 26 subjected to the elastic deformation into a predetermined shape in this way is fixedly welded to the frame 22 having the same shape as the peripheral potion of the mask body 21 of the shadow mask 15 to be formed.

This method of manufacturing the shadow mask 15 can retain the internal stress in the mask body 21 of the shadow mask 15 in such a direction as to reduce the radius of curvature of the mask body 21 along the short axis Y, whereby a shadow mask is provided with a high strength of holding the curved surface.

This method of manufacturing the shadow mask is not applicable to the conventional shadow mask having a spherically curved surface, but is effective for the fabrication of a shadow mask curved along the long axis or the short axis. Especially, the manufacturing method described above can exhibit a superior function and effect in an application for forming the shadow mask 15 according to the present embodiment having a curved surface with an infinitely large radius of curvature along the long axis X and with a predetermined curvature only along the short axis Y.

Now, actual examples of the shadow mask 15 will be explained.

ACTUAL EXAMPLE 1

An actual example 1 will be explained with reference to a shadow mask applied to a color cathode ray tube having an aspect ratio of 16:9 and a diagonal length of 66 cm constituting the main stream of color cathode ray tubes in recent years.

In this shadow mask 15, as shown in FIGS. 14, 16 to 17B, the effective surface 23 of the mask body 21 is formed as a cylindrically curved surface having an infinitely large radius of curvature along the long axis X and a fixed radius of curvature along the short axis Y over the entire range of the effective surface 23.

Table 7 shows the characteristics including the radius of curvature and the average radius of curvature of the effective surface of the shadow mask according to the actual example 1, as compared with those of a shadow mask having a spherical effective surface (reference 1) and a shadow mask having an infinitely large radius of curvature along the short axis and curved only along the long axis (reference 2).

TABLE 7

| | Actual Example 1 | Reference 1 | Reference 2 |
|---|---|---|---|
| Mask index R | 6.9R | 6.9R | 6.9R |
| Diagonal average radius of curvature of mask | R7782 | R7782 | R7782 |
| Diagonal corner fall of Mask | 7 | 7 | 7 |
| Max. radius of curvature | ∞ | R7782 | ∞ |
| Min. radius of curvature | R1873 | R7782 | R5912 |
| Average radius of curvature | $5.34 \times 10^{-4}$ | $2.57 \times 10^{-4}$ | $1.69 \times 10^{-4}$ |
| Sum of squares of radius of curvature | $2.85 \times 10^{-7}$ | $3.30 \times 10^{-8}$ | $2.86 \times 10^{-8}$ |

In Table 7, the shadow masks of the actual example 1 and the references 1 and 2 are tabular and 0.2 m thick formed in press as conventionally practiced. These shadow masks are formed with a curved surface having a fall of 7 mm at diagonal corners.

Comparison between a plurality of shadow masks having the same fall at the diagonal corners and different curved surfaces shows that the shadow mask according to the actual example 1 has a considerably larger average radius of curvature than those of the references 1 and 2. The sum of the squares of the radius of curvature is also large for the shadow mask of the actual example 1 as compared with those of the references. As described above, the strength of holding the curved surface of the shadow mask is affected by the average radius of curvature and the sum of squares of the radius of curvature. Generally, the larger these values, the higher the strength of holding the curved surface of the shadow mask. Further, the shadow mask shown in Table 7 has a large aspect ratio of 16:9 with a large difference between the horizontal size and the vertical size thereof. The shadow mask according to the actual example 1, therefore, has an especially large average radius of curvature and an especially large sum of the squares of radius of curvature as compared with the shadow masks of the references 1 and 2. The strength of holding the curved surface thus is seen to be considerably larger for the shadow mask of the actual example 1 than that for the references 1 and 2.

It is generally known that the local doming of the shadow mask can be controlled by increasing the radius of curvature of the portion of the shadow mask having a large deterioration of color purity. The shadow mask according to the actual example 1, as compared with those of the references 1 and 2, has a large radius of curvature in the particular area and therefore is exposed to a smaller local doming.

In the shadow mask 15 according to this embodiment, each electron beam passage aperture 32 formed in the mask body 21 has an elongate form extending along the short axis Y as shown in FIG. 15. A plurality of the electron beam passage apertures 32 are arranged in juxtaposition through bridges 33 along the short axis Y. Further, the electron beam passage apertures extending along the short axis Y are arranged in a plurality of lines at predetermined spatial intervals along the long axis X.

The mask body 21 having the electron beam passage apertures 32 arranged as mentioned above has continuously linear portions extending along the short axis Y but lacks such continuous linear portions along the long axis X. As a result, the mask body 21 has such an anisotropic property that the strength along the short axis thereof is higher than that along the long axis X. Taking into consideration the fact that the distance between the long sides of the mask body 21 is small in comparison with the distance between the short sides of the mask body 21 and that the mask body has an anisotropic property, therefore, curving the mask body along the short axis higher in strength than the long axis can produce a higher effect of controlling the doming for the same radius of curvature. Consequently, the shadow mask according to the actual example 1 has a higher effect of suppressing the local doming than the first and second references. Further, the fabrication of the shadow mask by the above-mentioned fabrication method can retain the internal stress in the mask body in such a direction as to reduce the radius of curvature along the short axis higher in strength, and thus can maintain a sufficient strength of holding the curved surface.

In view of these facts, a color cathode ray tube can be obtained which can resist the shocks and vibrations which may be exerted on the color cathode ray tube and which hardly deteriorate in color purity.

ACTUAL EXAMPLE 2

The actual example 1 relates to a shadow mask of a color cathode ray tube having an aspect ratio of 16:9 and a diagonal length of 66 cm and including a mask body 0.2 mm thick. In an actual example 2, on the other hand, a flat mask as thin as 0.18 mm is pressed to make a shadow mask having a cylindrically curved surface.

With a thin mask body as mentioned above, the uniformity of the shape and size of the electron beam passage apertures formed in the mask body by photoetching can be improved while at the same time reducing the production cost. In addition, in spite of a smaller thickness, it is possible to secure a strength of holding the curved surface at least equal to that of the shadow masks of the references 1 and 2 having the strength of holding the curved surface as shown in Table 7.

ACTUAL EXAMPLE 3

Like in the actual examples 1 and 2, a shadow mask applicable to a color picture ray tube having an aspect of 16:9 and a diagonal dimension of 66 cm is fabricated with the same average radius of curvature and the same sum of squares of the radius curvature as in the reference 2 shown in Table 7.

Following Table 8 shows the characteristics including the radius of curvature and the average radius of curvature of the effective surface of the shadow mask according to the actual example 3, as compared wit those of the actual example 1 and the reference 2.

TABLE 8

| | Actual Example 3 | Actual Example 1 | Reference 2 |
|---|---|---|---|
| Mask index R | 22.0R | 6.9R | 6.9R |
| Diagonal average radius of curvature of mask | R24639 | R7782 | R7782 |
| Diagonal corner fall of Mask | 2.2 | 7 | 7 |
| Max. radius of curvature | ∞ | ∞ | ∞ |
| Min. radius of curvature | R5912 | R1873 | R5912 |
| Average radius of curvature | $1.69 \times 10^{-4}$ | $5.34 \times 10^{-4}$ | $1.69 \times 10^{-4}$ |
| Sum of squares of radius of curvature | $2.86 \times 10^{-8}$ | $2.85 \times 10^{-7}$ | $2.86 \times 10^{-8}$ |

The shadow mask of the actual example 3 shown above is configured to have the same average radius of curvature and the same sum of squares of the radius of curvature as the reference 2 taking into consideration of the geometry of the inner surface of the effective area of the face panel. The shadow mask according to the reference 2 has a radius of curvature of R5912 along the long axis and an infinitely large radius of curvature along the short axis, whereas the shadow mask according to the actual example 3 conversely has an infinitely large radius of curvature along the long axis and a predetermined value R5912 of radius of curvature along the short axis.

In other words, the shadow mask of the actual example 3 has a radius of curvature along the short axis similar to the radius of curvature along the long axis of the reference 2, and therefore has a greater effect of suppressing the local doming as described above, thereby reducing the deterioration of the color purity of the color cathode ray tube.

Also, as shown in Table 8, the average radius of curvature of the shadow mask according to the actual example 3 is identical to that of the reference 2. Because of the aspect ratio of 16:9, however, the fall of the diagonal corners of the shadow mask according to the actual example 3 assumes a value of 2.2 considerably different from the FIG. 7.0 for the shadow mask of the reference 2. As a result, the effective area 23 is considerably flattened. The effective area of the face panel can thus be flattened in accordance with the curve of the shadow mask surface.

ACTUAL EXAMPLE 4

An actual example 4, like the actual examples 1 to 3, concerns a shadow mask applicable to a color picture tube having an aspect ratio of 16:9 and a diagonal length of 66 cm, in which the curved surface of the effective area is configured to have an infinitely large radius of curvature along the long axis X and a predetermined radius of curvature along the short axis Y expressed by a high-order polynomial unlike the arcuate surface with a single radius of curvature along the short axis Y in the actual examples 1 to 3. Also, the shadow mask according to the actual example 4 has a fall of 7 mm at the diagonal corners.

Specifically, the effective surface of the shadow mask forms a curved surface expressed as $Z=\Sigma a_i Y^{2i}$, where a is a coefficient and i=0, 1, 2, . . . ,n, in a coordinate system with an origin at the center of the effective surface, a long axis as the X axis, a short axis as the Y axis and a tube axis as the Z axis, and having the side thereof opposed to the effective area of the face panel turned up.

In particular, the actual example 4 is formed in a shape expressed by the following equations, assuming that n=2.

$$Z=a1Y^2+a2Y^4$$

$$a1=-2.139\times10^{-4}$$

$$a2=-2.919\times10^{-10}$$

This shadow mask has the fourth-order components of 20% and the second-order components of 80% given by the fourth-order polynomial described above, leading to a slightly larger radius of curvature of the peripheral edge of the effective surface than that of the shadow mask of the actual example 3. The geometry of the mask along the short axis on the short axis is expressed by the fourth-order function as $$Z=-2.139\times10^{-4}Y^2-2.919\times10^{-10}Y^4$$

The curved surface in the direction parallel to the short axis at an arbitrary point of the mask body also assumes the same shape as mentioned above.

In the case where the effective area of the shadow mask is formed as a curved surface as mentioned above, the radius of curvature along the short axis in the neighborhood of the long axis can be reduced slightly and the radius of curvature along the short axis in the neighborhood of the long side of the mask body can be slightly increased. Especially, the strength of holding the curved surface of the mask body can be increased to such an extent as to be balanced appropriately over the effective surface of the shadow mask.

The present invention is not limited to the above mentioned embodiments, but also various changes and modifications may be applied within the scope of the invention. For example, in a cathode ray tube according to the present invention, the effective area of the face panel may be formed with the outer and inner surfaces having the shapes described in the first and second embodiments, and this effective area may be combined with the shadow mask described in the second embodiment.

We claim:

1. A cathode ray tube comprising:

a vacuum envelope including a face panel and a funnel, the face panel having a substantially rectangular effective area;

a phosphor screen formed on an inner surface of the face panel; and an electron gun arranged in a neck of the funnel for emitting electron beams toward the phosphor screen;

wherein the effective area of the face panel has a long axis extending in a horizontal direction and a short axis extending in a vertical direction, the effective area having a cylindrically curved outer surface with a substantially infinitely large radius of curvature along the long axis and a finite radius of curvature over the whole outer surface along the short axis, said finite radius being less than said substantially infinitely large radius.

2. A cathode ray tube according to claim 1, wherein the outer surface of the effective area is curved with the radius of curvature along the short axis expressed by a high-order polynomial.

3. A cathode ray tube according to claim 1, wherein the ratio between the length of the long axis and the length of the short axis of the effective area is 16:9.

4. A cathode ray tube comprising:

a vacuum envelope including a face panel and a funnel, the face panel having a substantially rectangular effective area;

a phosphor screen formed on an inner surface of the face panel; and an electron gun arranged in a neck of the funnel for emitting electron beams toward the phosphor screen, wherein the effective area of the face panel has a long axis extending in a horizontal direction and a short axis extending in a vertical direction, the effective area having a curved outer surface with a substantially infinitely large radius of curvature along the long axis and a radius of curvature along the short axis which is different between a portion on the short axis and a portion near a short side of the effective area.

5. A cathode ray tube according to claim 4, wherein the ratio between the length of the long axis and the length of the short axis of the effective area is 16:9.

6. A cathode ray tube comprising:

a vacuum envelope including a face panel and a funnel, the face panel having a substantially rectangular effective area;

a phosphor screen formed on an inner surface of the face panel; and an electron gun arranged in a neck of the funnel for emitting electron beams toward the phosphor screen, wherein the effective area of the face panel has a long axis extending in a horizontal direction and a short axis extending in a vertical direction, the effective area having a substantially flat outer surface and a cylindrically curved inner surface which has an infinitely large radius of curvature along the long axis and a finite radius of curvature over the whole inner surface along the short axis, said finite radius being less than said substantially infinitely large radius.

7. A cathode ray tube according to claim 6, wherein the inner surface of the effective area is curved with the radius of curvature along the short axis expressed by a high-order polynomial.

8. A cathode ray tube according to claim 6, wherein the ratio between the length of the long axis and the length of the short axis of the effective area is 16:9.

9. A cathode ray tube comprising:

a vacuum envelope including a face panel and a funnel, the face panel having a substantially rectangular effective area;

a phosphor screen formed on an inner surface of the face panel; and an electron gun arranged in a neck of the funnel for emitting electron beams toward the phosphor screen, wherein the effective area of the face panel has a long axis extending in a horizontal direction and a short axis extending in a vertical direction, the effective area having a curved outer surface with a substantially infinitely large radius of curvature along the long axis and an arbitrary radius of curvature along the short axis, the effective area further having a cylindrically curved inner surface with a substantially infinitely large radius of curvature along the long axis and a finite radius of curvature over the whole inner surface along the short axis, said finite radius being less than said substantially infinitely large radius.

10. A cathode ray tube according to claim 9, wherein the outer surface of the effective area is curved with the radius of curvature along the short axis expressed by a high-order polynomial.

11. A cathode ray tube according to claim 9, wherein the ratio between the length of the long axis and the length of the short axis of the effective area is 16:9.

12. A cathode ray tube comprising: a vacuum envelope including a face panel and a funnel, the face panel having a substantially rectangular effective area; a phosphor screen formed on an inner surface of the face panel; and an electron gun arranged in a neck of the funnel for emitting electron beams toward the phosphor screen; wherein the effective area of the face panel has a long axis extending in a horizontal direction and a short axis extending in a vertical direction, the effective area having a substantially flat outer surface and a curved inner surface with an arbitrary radius of curvature along the long axis and a radius of curvature alone the short axis which is different between the portion on the short axis and a portion near the short side of the effective area.

13. A cathode ray tube comprising:

a vacuum envelope including a face panel and a funnel, the face panel having a substantially rectangular effective area;

a phosphor screen formed on an inner surface of the face panel;

a shadow mask arranged in the vacuum envelope to oppose the phosphor screen, the shadow mask including a mask body having a substantially rectangular effective surface in opposed relation to the phosphor screen and a number of electron beam passage apertures formed in the effective surface, and a substantially rectangular frame for supporting a peripheral edge of the mask body; and an electron gun arranged in a neck of the funnel for emitting electron beams toward the phosphor screen through the shadow mask, wherein the effective surface of the mask body has a long axis extending in a horizontal direction and a short axis extending in a vertical direction, the effective surface having substantially infinitely large radius of curvature along the long axis and a finite radius of curvature over the whole of the effective surface along a short axis, said finite radius being less than said substantially infinitely large radius.

14. A cathode ray tube according to claim 13, wherein the mask body is fixed to the frame with a stress applied thereto in such a direction as to reduce the radius of curvature along the short axis.

15. A cathode ray tube according to claim 13, wherein each of the electron beam passage apertures has an elongate form extending in a direction parallel to the short axis of the mask body, and a plurality of the electron beam passage apertures are arranged in a row through bridges in a direction parallel to the short axis of the mask body, and a plurality of rows of said electron beam passage apertures are arranged in parallel with one another with intervals along the long axis of the mask body.

16. A cathode ray tube according to claim 13, wherein the effective surface of the mask body is formed to have the ratio of 16:9 between the size along the long axis and the size along he short axis thereof.

17. A cathode ray tube according to claim 13, wherein the effective area of the face panel has a long axis extending in horizontal direction and a short axis extending in vertical direction, and the effective area has a substantially flat outer surface and a cylindrically curved inner surface which has a substantially infinitely large radius of curvature along the long axis and a finite radius of curvature over the whole inner surface along the short axis, said finite radius being less than said substantially infinitely large radius.

18. A cathode ray tube according to claim 17, wherein the inner surface of the effective area is curved with the radius of curvature along the short axis expressed by a high-order polynomial.

19. A cathode ray tube according to claim 13, wherein the effective area of the face panel has a long axis extending in horizontal direction and a short axis extending in vertical direction, the effective area having a curved outer surface with an infinitely large radius of curvature along the long axis and an arbitrary radius of curvature along the short axis, and a cylindrically curved inner surface with a substantially infinitely large radius of curvature along the long axis and a finite radius of curvature over the whole inner surface along the short axis, said finite radius being less than said substantially infinitely large radius.

20. A cathode ray tube according to claim 19, wherein the outer and inner surfaces of the effective area are curved with the radius of curvature along the short axis expressed by a high-order polynomial.

21. A cathode ray tube comprising:

a vacuum envelope including a face panel and a funnel, the face panel having a substantially rectangular effective area;

a phosphor screen formed on an inner surface of the face panel;

a shadow mask arranged in the vacuum envelope to oppose the phosphor screen, the shadow mask including a mask body having a substantially rectangular effective surface in opposed relation to the phosphor screen and a number of electron beam passage apertures formed in the effective surface, and a substantially rectangular frame for supporting a peripheral edge of the mask body; and an electron gun arranged in a neck of the funnel for emitting electron beams toward the phosphor screen through the shadow mask;

wherein the effective surface of the mask body has a long axis extending in a horizontal direction and a short axis extending in a vertical direction, the effective surface having an infinitely large radius of curvature along the long axis and a radius of curvature along the short axis expressed by a high-order polynomial.

22. A cathode ray tube according to claim 21, wherein the mask body is fixed to the frame with a stress applied in a direction as to reduce the radius of curvature along the short axis.

23. A cathode ray tube according to claim 21, wherein each of the electron beam passage apertures has an elongate form extending in a direction parallel to the short axis of the mask body, a plurality of the electron beam passage apertures are arranged in a row through bridges in a direction parallel to the short axis of the mask body, and a plurality of rows of said electron beam passage apertures are arranged in parallel with one another with intervals along the long axis of the mask body.

24. A cathode ray tube according to claim 21, wherein the effective surface of the mask body is formed to have the ratio of 16:9 between the size along the long axis and the size along the short axis thereof.

25. A method of manufacturing a cathode ray tube comprising:

a vacuum envelope including a face panel and a funnel, the face panel having a substantially rectangular effective area;

a phosphor screen formed on an inner surface of the face panel;

a shadow mask arranged in the vacuum envelope to oppose the phosphor screen, the shadow mask including a mask body having a substantially rectangular effective surface in opposed relation to the phosphor screen and a number of electron beam passage apertures formed in the effective surface, and a substantially rectangular frame for supporting a peripheral edge of the mask body; and an electron gun arranged in a neck of the funnel for emitting electron beams toward the phosphor screen through the shadow mask;

said method comprising:

preparing a substantially rectangular flat mask formed with a number of electron beam passage apertures;

subjecting the flat mask to a plastic deformation thereby to form a mask body having a cylindrically curved surface having a substantially infinitely large radius of curvature along a long axis of the mask body and having a finite curvature along a short axis of the mask body, said finite radius being less than said substantially infinitely large radius; and subjecting the mask body to an elastic deformation in such a manner that the radius of curvature along the short axis of the mask body is larger than the radius of curvature thereof at the time of the plastic deformation; and fixing a peripheral edge of the elastically deformed mask body to the frame.

26. A cathode ray tube comprising:

a vacuum envelope including a face panel and a funnel, the face panel having a substantially rectangular effective area;

a phosphor screen formed on an inner surface of the face panel; and an electron gun arranged in a neck of the funnel for emitting electron beams toward the phosphor screen;

wherein, said effective area of the face panel has a long axis extending in horizontal direction and a short axis extending in vertical direction, the effective area having a substantially flat outer surface and a curved inner surface with an arbitrary radius of curvature along the long axis and different radius of curvature on the short axis and in the neighborhood of the vertical side of the effective area alone the short axis;

the inner surface of the effective area of the face panel is formed to satisfy a relationship, $Vp>Hp$, where Hp is a fall of the inner surface at the end of the long axis relative to the center of the inner surface of the effective area, and Vp is a fall of the inner surface at the end of the short axis relative to the center of the inner surface.

27. A cathode ray tube according to claim 26, wherein the inner surface of the effective area of the face panel is formed to satisfy a relationship, $Dp \geqq Vp>Hp$, where Dp is a fall of the inner surface at the end of the diagonal axis relative to the center of the inner surface of the effective area.

28. A cathode ray tube comprising:

a vacuum envelope including a face panel and a funnel, the face panel having a substantially rectangular effective area;

a phosphor screen formed on an inner surface of the face panel; and an electron gun arranged in a neck of the funnel for emitting electron beams toward the phosphor screen, wherein said effective area of the face panel has a long axis extending in a horizontal direction and a short axis extending in vertical direction, the effective area having a substantially flat outer surface and a curved inner surface with an arbitrary radius of curvature;

the inner surface of the effective area of the face panel is formed to satisfy a relationship, $Vp>Hp$, where Hp is the a fall of the inner surface at the end of the long axis relative to the center of the inner surface of the effective area, and Vp is a fall of the inner surface at the end of the short axis relative to the center of the inner surface.

29. A cathode ray tube according to claim 28, wherein the inner surface of the effective area of the face panel is formed to satisfy a relationship, $Dp \geqq Vp>Hp$, where Dp is a fall of the inner surface at the end of the diagonal axis relative to the center of the inner surface of the effective area.

* * * * *